US008739816B2

(12) United States Patent
Chang

(10) Patent No.: US 8,739,816 B2
(45) Date of Patent: Jun. 3, 2014

(54) FIRE HYDRANT BOX

(75) Inventor: Wen-Chun Chang, New Taipei (TW)

(73) Assignee: Chuan Yen Tech Co., Ltd., New Taipei (TW)

( * ) Notice: Subject to any disclaimer, the term of this patent is extended or adjusted under 35 U.S.C. 154(b) by 271 days.

(21) Appl. No.: 13/345,745

(22) Filed: Jan. 8, 2012

(65) Prior Publication Data

US 2012/0192960 A1 Aug. 2, 2012

(30) Foreign Application Priority Data

Feb. 1, 2011 (TW) ..... 100202372 A

(51) Int. Cl.

| | |
|---|---|
| ***B65H 75/38*** | (2006.01) |
| ***B65H 75/18*** | (2006.01) |
| ***B65H 75/44*** | (2006.01) |
| ***A62C 35/20*** | (2006.01) |

(52) U.S. Cl.

USPC ..... 137/355.26; 137/355.2; 169/51

(58) Field of Classification Search

USPC ..... 137/355.12, 355.16–355.28; 169/5, 46, 169/51, 52

See application file for complete search history.

(56) References Cited

U.S. PATENT DOCUMENTS

| | | | | | |
|---|---|---|---|---|---|
| 357,154 | A * | 2/1887 | Reynolds | 137/355.19 |
| 2,216,384 | A * | 10/1940 | Brown | 137/355.27 |
| 3,183,927 | A * | 5/1965 | Swartz et al. | 137/355.19 |
| 4,062,493 | A * | 12/1977 | Suggs | 239/197 |
| 4,137,939 | A * | 2/1979 | Chow | 137/355.27 |
| 5,381,981 | A * | 1/1995 | Nelson | 242/407.1 |
| 5,404,900 | A * | 4/1995 | Fletchall | 137/355.27 |
| 5,678,599 | A * | 10/1997 | Moss | 137/377 |
| 6,546,953 | B1 * | 4/2003 | Kowalke | 137/355.16 |
| 6,953,049 | B2 * | 10/2005 | Kowalke | 137/355.23 |
| 2005/0066829 | A1 * | 3/2005 | Cogswell | 101/368 |
| 2007/0102555 | A1 * | 5/2007 | Franklin et al. | 242/404 |

* cited by examiner

*Primary Examiner* — Craig Schneider

*Assistant Examiner* — Jonathan Waddy

(74) *Attorney, Agent, or Firm* — Chun-Ming Shih; HDLS IPR Services

(57) ABSTRACT

A fire hydrant box accommodates a hand held firefighting spray gun, a water inlet pipe with a rotary connector and a connection unit. A positioning member capable of bearing gravity is installed on the sidewall inside the box. A rotary member is movably connected with the positioning member, from which two supporting members extend to engage and support a rotary base of a firefighting hose assembly. The rotary base includes a rolling mechanism used to roll the fire hose thereon. Two rolling disks are provided to two sides of the rolling mechanism. One rolling disk is provided with a handle to roll and release the fire hose, and the other rolling disk is connected to the water inlet pipe. The connection unit can be easily rotated out of the accommodating space in order for the fireman to easily access the fire hose and the firefighting spray gun.

5 Claims, 10 Drawing Sheets

FIRE HYDRANT BOX

BACKGROUND

1. Field of the Invention

The present invention relates to a fire hydrant box. More particularly, the present invention relates to a fire hydrant box, in which the fire hose can be easily accessed or rolled up via a connection unit including a plurality of needle bearings to engage with a rotary shaft. The firefighting hose assembly, by way of smoothly rotating the connection unit, can be easily pulled out of or restored back to the fire hydrant box.

2. Description of Background Art

With the development of the economy and the scientific and technologic progress, people's living standards have improved. While the living space is gradually being compressed and decreased, there are more and more high-rise buildings, industrial factories, science and technology zones built, which although providing daily work or living environment with more spacious and comfortable spaces, the fire safety becomes the high priority and has to be paid attention. In all kinds of the high-rise buildings, one or more fire hydrant boxes are installed in the stairwell or corridor wall, so that in case of fire, the fire hose contained within the fire hydrant box can be accessed and used to extinguish the fire, thus reducing accidental losses.

Conventional fire hydrant box broadly used in the buildings is shown in FIGS. 9 and 10. The conventional fire hydrant box A includes an accommodating space A0 to receive a fire hose A1 which is wound into a ring shape, as shown in FIG. 9. Alternatively, the fire hose A1 is convoluted on a plurality of supporting rods A2 provided in the fire hydrant box A0, as shown in FIG. 10. In case of fire, the fire hose is pulled out of the accommodating space A0 of the fire hydrant box A to extinguish the fire. However, the conventional fire hydrant box, during the actual operation and implementation, has many disadvantages as follows.

(1) Since the fire hose A1 is rolling up or convoluted in the fire hydrant box A, pulling the fire hose A1 out of the fire hydrant box A for use will easily cause the fire hose to twist and be knotted, thus slowing down the fire extinguishing speed.

(2) After the fire hose A1 is taken out, the fire hose A1 has to be re-rolled up or re-convoluted for storage inside the accommodating space A0 of the fire hydrant box A. During restoring, it is difficult to control the length of the fire hose A1, and therefore it might need to repeat rolling or convoluting so as to make sure the rolled or convoluted fire hose can fit in the accommodating space A0 of the fire hydrant box A, which causes the taking out and restoring the fire hose A1 to be a time-consuming work needing a lot of effort.

(3) After finishing the use of the fire hose A1, due to the long length of the fire hose A1, it is difficult to remove the residual water within the fire hose A1 from the water outlet (not shown) of the fire hose. During restoring, the portion of the fire hose A1 with the residual water therein will bulge, thus causing difficulty for the operation.

Therefore, there exists a need for the existing fire hydrant box manufacturers in the industry to improve the drawbacks and provide a way to obviate the problems of the inconveniences of accessing and restoring the fire hose, and the difficulty of removing the residual water in the fire hose as noted above.

BRIEF SUMMARY

The present invention is to provide a fire hydrant box including an accommodating space to receive a hand held firefighting spray gun, and a water inlet pipe for introducing external water supply for firefighting. A positioning member capable of bearing gravity is installed on the sidewall inside the accommodating space. A connecting mechanism includes a plurality of needle bearings configured to be passed through by a metal rotary shaft. A rotary member is movably connected with the positioning member, from which two supporting members each including a fixing mechanism at its cantilever end extend to engage and support a rotary base of a firefighting hose assembly. The rotary base includes a rolling mechanism with a plurality of rolling rods which are provided to roll the fire hose thereon. One end of the fire hose is connected to the firefighting spray gun via a hose connector. Two rolling disks are provided to two sides of the rolling mechanism correspondingly. One of the rolling disks is provided with a handle used to roll and release the fire hose, and the other one of the rolling disks is provided with a rotary connector connecting with the water supply pipe that is connected to the water inlet pipe. The connection unit including the positioning member and the rotary member can therefore make the firefighting hose assembly easily rotated out of the accommodating space in order for the fireman to easily access the fire hose and the firefighting spray gun.

Another, the present invention is to provide a rotary assembly by way of a loose-leaf assembling, including the positioning member, the rotary member and the connecting mechanism provided on the corresponding sides, to be connected with each other, of the positioning member and the rotary member. The connecting mechanism includes a plurality of shaft holes, through which the metal rotary shaft passes through a plurality of needle bearings, so that the positioning member and the rotary member can smoothly rotate relative to each other. The firefighting hose assembly supported on the rotary assembly can therefore easily be pulled out or pushed back to the accommodating space of the fire hydrant box by way of rotating.

Still another, the present invention is to provide a baffle and a rolling disk on each side of the rolling mechanism. By rotating the handle provided to one of the rolling disks, the rolling mechanism including a plurality of rolling rods rotates so as to roll or release the fire hose, so that the fire hose can be easily and swiftly rolled together and taken out without twisting, being knotted or being broken, thus extending the service life of the fire hose.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
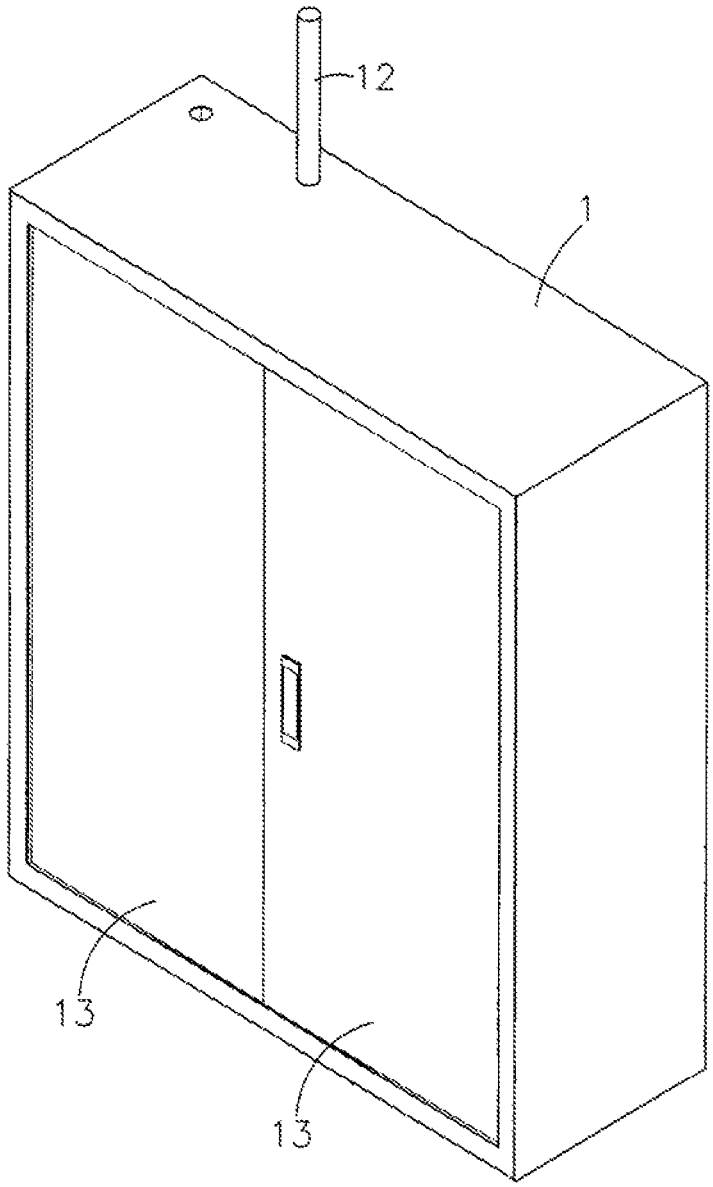
FIG. 1 is a perspective view of the present invention.

The present invention will now be described with reference to the accompanying drawings in which the same reference numerals have been used to identify the same or similar elements.

Figure 2:
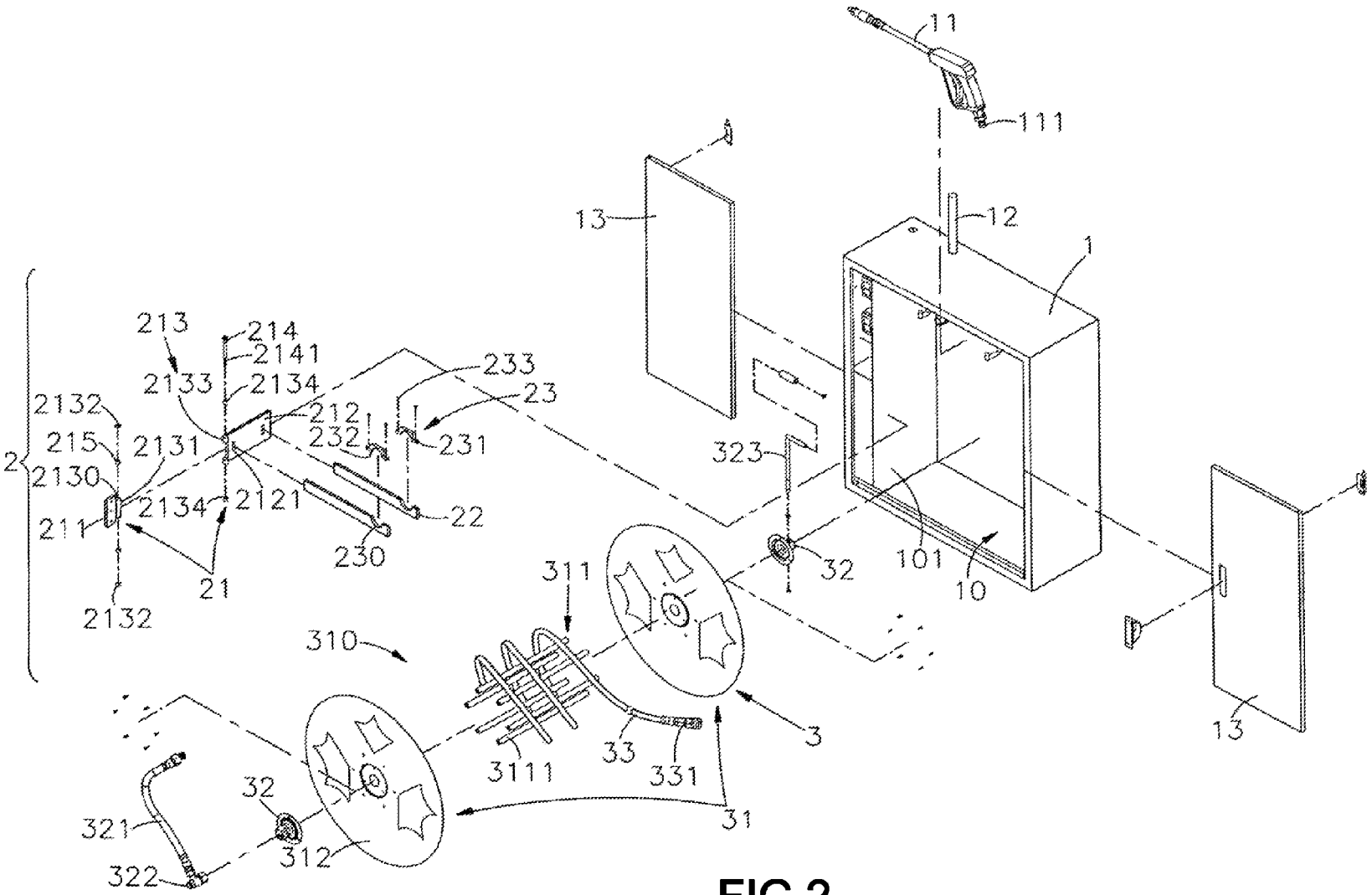
FIG. 2 is an exploded view of the present invention.
Figure 3:
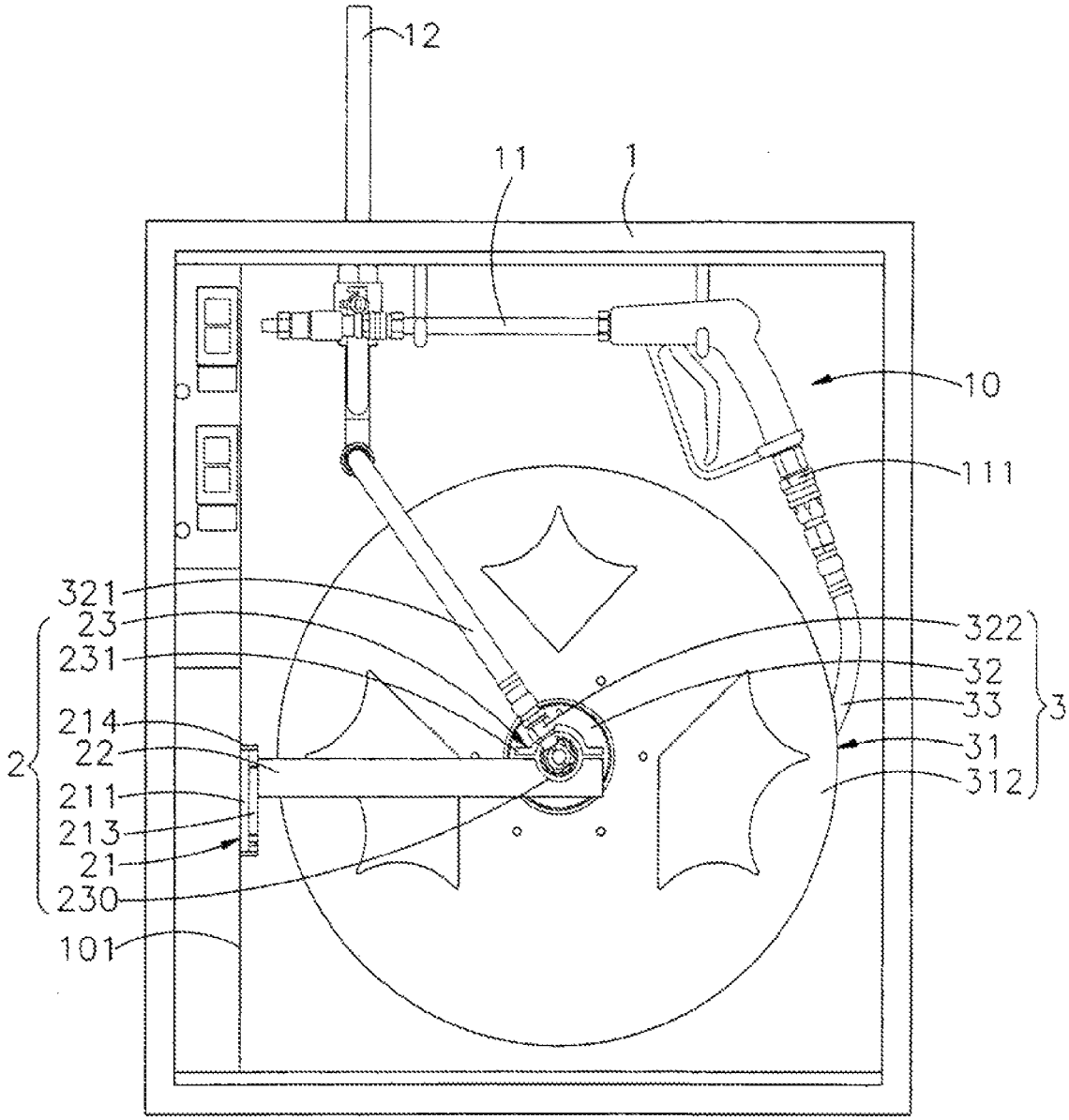
FIG. 3 is a front view of the present invention.
Figure 4:
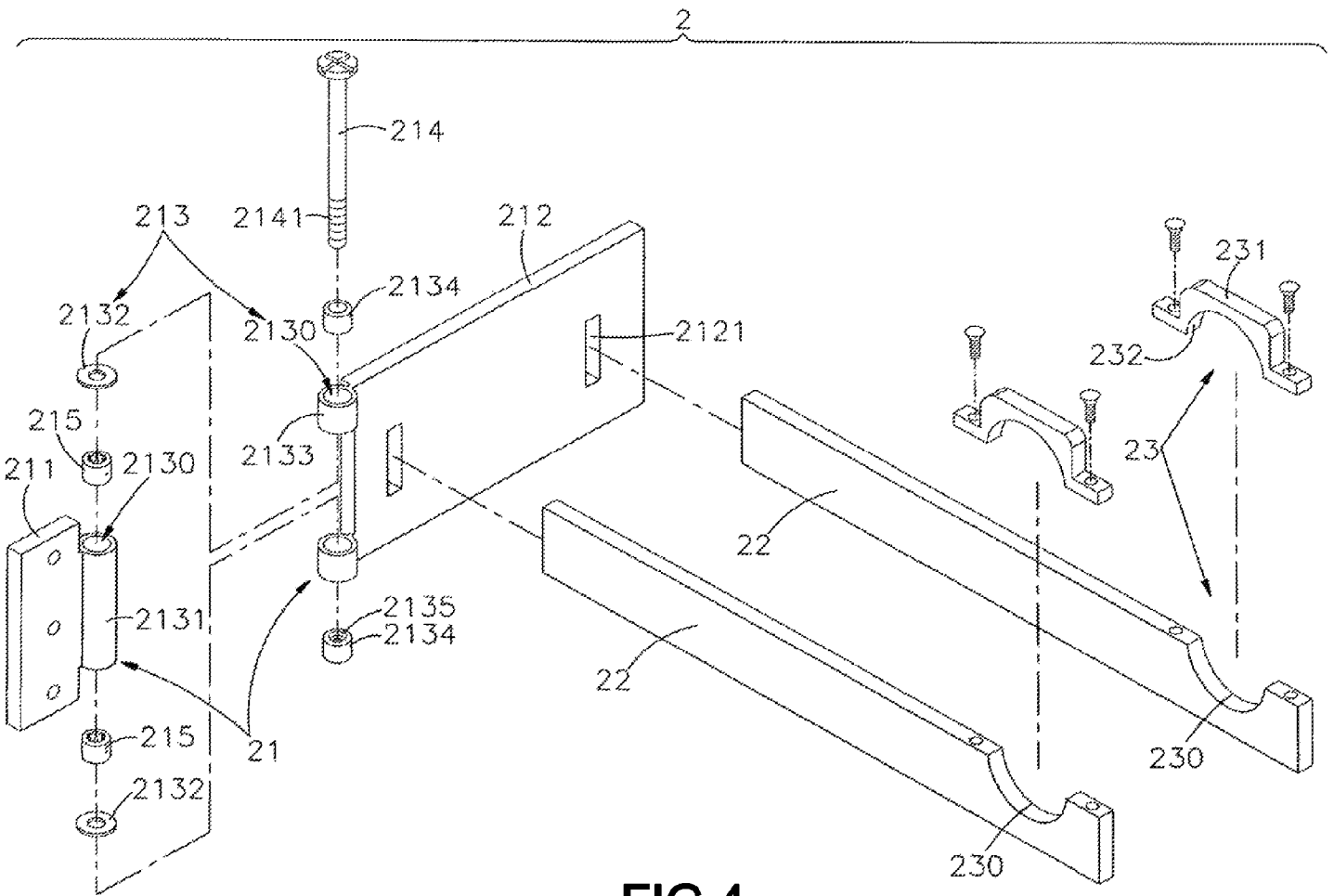
FIG. 4 is an exploded view of the rotating assembly according to one embodiment of the present invention.

Referring to FIGS. 1-4, the fire hydrant box according to the present invention includes a box body 1, a connection unit 2 and a firefighting hose assembly 3. The box body 1 is provided with an accommodating space 10. A firefighting spray gun 11 is disposed within the accommodating space 10. The accommodating space 10 is further provided with a water feeding pipe 12 extending to the outside of the box body 10, and a door 13 movably to open and close. The connection unit 2 includes a rotating assembly 21 and two supporting members 22. The rotating assembly 21 has a positioning member 211 for a loose leaf type assembly and a rotary member 212. A connecting mechanism 213 is provided for assembly of the positioning member 211 and the rotary member 212. The connecting mechanism 213 includes a sleeve 2131 on the corresponding side of the positioning member 211. Inside the shaft hole 2130 of the sleeve 2131, a plurality of needle bearings 215 are provided to the sleeve 2131. Two gaskets 2132 are respectively provided to the two ends of the sleeve 2131. On the corresponding side of the rotary member 212, the connecting mechanism 213 includes two tubes 2133 facing each other formed thereon. Each of the tubes 2133 is provided with a copper bushing 2134 disposed therein. In assembling the positioning member 211, the rotary member 212 and the connecting mechanism 213, a rotary shaft 214 is configured to pass through one copper bushing 2134, the plurality of needle bearings 215 via the shaft holes 2130 in sequence, and then engage and interlock with the internal threaded hole 2135 of the other copper bushing 2134 via the external screw thread 2141 provided on one side of the rotary shaft 214, so that the positioning member 211 and the rotary member 212 can rotate and swing about the rotary shaft 214 smoothly relative to each other. The two supporting members 22 extend from one side of the rotary member 212 to form a pair of cantilever arms parallel with each other. Each of the supporting members 22 is provided with one fixing mechanism 23 at the cantilever end thereof. Each of the fixing mechanism 23 includes a groove 230 formed at the cantilever end of the corresponding supporting member 22 and an arc clamping element 231 corresponding to the groove 230, so that each arc clamping element 231 can be installed on the corresponding groove 230 accordingly.

The firefighting hose assembly 3 includes a rotation base 31 having a rolling mechanism 311. The rolling mechanism 311 includes a plurality of rolling rods 3111. A baffle 312 and a rolling disk 32 are disposed on each side of the rolling rods 3111. A water supply pipe 321 is connected to the rolling disk 32 at one side of the rotation base 31. One end of the water supply pipe 321 connects a rotary connector 322 which is able to freely rotate 360 degrees. The rolling disk 32 at the other side of the rotation base 31 is configured with a handle 323 which is used to drive the rolling rod 3111 of the rolling mechanism 311 to rotate. The handle 323 is rotatable to wind a fire hose 33 on the rolling rod 3111 of the rolling mechanism 311 within a receiving space 310 formed between the two baffles 312. Furthermore, a hose connector 331 connects the end of the fire hose 33.

When assembling the fire hydrant box, the positioning member 211 is provided to install the rotating assembly 21 of the connection unit 2 on the proper high level of the interior sidewall 101. The rotary member 212, which is movably engaged to the positioning member 211, and the two supporting members 22 extending from the rotary member 212, are using the connecting mechanism 213 as an axis to rotate 90 degrees outwardly. The fixing mechanism 23 provided to the cantilever ends of the two supporting members 22 includes two grooves 230 and two arc clamping elements 231 to clamp the rotating base 31 on two axles of two rolling disks 32 at outer surfaces of the two baffles 312, respectively, thus connecting the firefighting hose assembly 3 to the rotating assembly 21 of the connection unit 2. Via the rotary member 212 of the rotating assembly 21 and the two supporting members 22, the firefighting hose assembly 3 rotates to exit the accommodating space 10, or rotates back to the accommodating space 10. The box body 1, connection unit 2, and firefighting hose assembly 3 build up the fire hydrant box of present invention.

The box body 1 of the fire hydrant box is assembled on the stairwell of buildings or the wall of corridors, and the door 13 being able to be opened is set to one side of the accommodating space 10. The door 13 can be a single-plate rotary door, a single-plate horizontal pulling door, a double-plate rotary door, a double-plate horizontal pulling door, or a coiling door, etc., which is provided to be opened so that the firefighting hose assembly 3 can be taken out from the accommodating space 10 via the connection unit 2. The box body 1 is installed to the target wall as an empty box, and then the connection unit 2 is installed to the interior sidewall 101 of the accommodating space 10 of the box body 1. When the rotary member 212 of the rotating assembly 21 rotate 90 degrees outward from the box body 1, the two parallel cantilever arm type supporting members 22 extending from the rotary member 212 can move to the outside of the accommodating space 10 of the box body 1. The rotating base 31 of the firefighting hose assembly 3 is clamped in a clamping space 232 formed by the cantilever ends of the two supporting members 22. The rotary member 212 is configured to rotate 90 degrees back after the firefighting hose assembly 3 is assembled in the clamping space 232 between the two supporting members 22, and the accommodating space 10 can easily restore the firefighting hose assembly 3.

The rotating assembly 21 of the connection unit 2 has a good weight carrying ability, and is able to bear the weight of the firefighting hose assembly 3. The rotating assembly 21 is assembled by the way of a loose-leaf assembling, which comprises the positioning member 211 and the rotary member 212. The connecting mechanism 213 is provided to the corresponding sides, to be connected with each other, of the positioning member 211 and the rotary member 212. The connecting mechanism 213 has the sleeve 2131 and two shaft tubes 2133. The copper bushings 2134 are installed within the two shaft tubes 2133, respectively, and a plurality of needle bearings 215 are installed in the sleeve 2131. The connecting mechanism 213 has the shaft holes 2130, and the metal rotary shaft 214 is configured to pass through the connecting mechanism 213 via the shaft holes 2130. The metal rotary shaft 214 can cooperate with the sleeve 2131 of the connecting mechanism 213, the plurality of needle bearing 215, the two shaft tubes 2133, and the two copper bushings 2134, so as to form a smooth relative rotation between the positioning member 211 and the rotary member 212, and the strength-saving effect is achieved for swinging the rotary member 212 with respect to the positioning member 211. The positioning member 211 of the rotating assembly 21 can be fixed to the interior sidewall 101 of the box body 1 by using a plurality of screws, rivet, or by the way of welding. The rotary member 212 has the slots 2121 for assembling or locking the two supporting members 22, and the two supporting members 22 are welded to the rotary member 212. The rotary member 212 has two parallel, cantilever arm type supporting members 22 extended outward from the rotary member 212. Using the connecting mechanism 213 as an axle, the supporting members 22 rotate and swing through the rotary member 212. The fixing mechanism 23 provided to the cantilever portion of the supporting members 22 is located on the cantilever portion of the supporting member 22, and the two cantilever portions each has the groove 230 assembled with the arc clamping element 231. The clamping space 232 is formed between the groove 230 and the clamping element 231. The two supporting members 22 clamp at the outside of the two baffles 312 of the rotating base 31 of the firefighting hose assembly 3, respectively. The two clamping elements 231 can use a plurality of the screws 233 to install on the two supporting members at the grooves 230, respectively.

The rotating base 31 of the firefighting hose assembly 3 is formed with the receiving space 310 between the two baffles 312. The rolling rod 3111 of the connecting mechanism 311 of the rotating base 31 located in the receiving space 310 can roll the fire hose 33, or the fire hose 33 can be pulled out from the receiving space 310. The hose connector 331 is provided at the distal end of the fire hose 33, and the water supply connector 111 of the spray gun 11 is connected to the hose connector 331. The rolling disk 32 is connected to the rotary connector 322, and the rotary connector 322 is able to freely rotate in 360 degrees. The rotary connector 322 is further connected to the water supply pipe 321, and the water supply pipe 321 is connected to the water feeding pipe 12 in the box body 1. The water supply pipe 321 is made of soft material, such as coil, plastic tube, or fire hose, etc. The water supply pipe 321 can lead the water (or foam, chemical agent or powder, etc.), by the water feeding pipe 12, and the water can be introduced through the water supply pipe 321, the connecting mechanism 311, the fire hose 33, the spray gun 11, in sequence, to do the fire extinguishing spraying.

Figure 5:
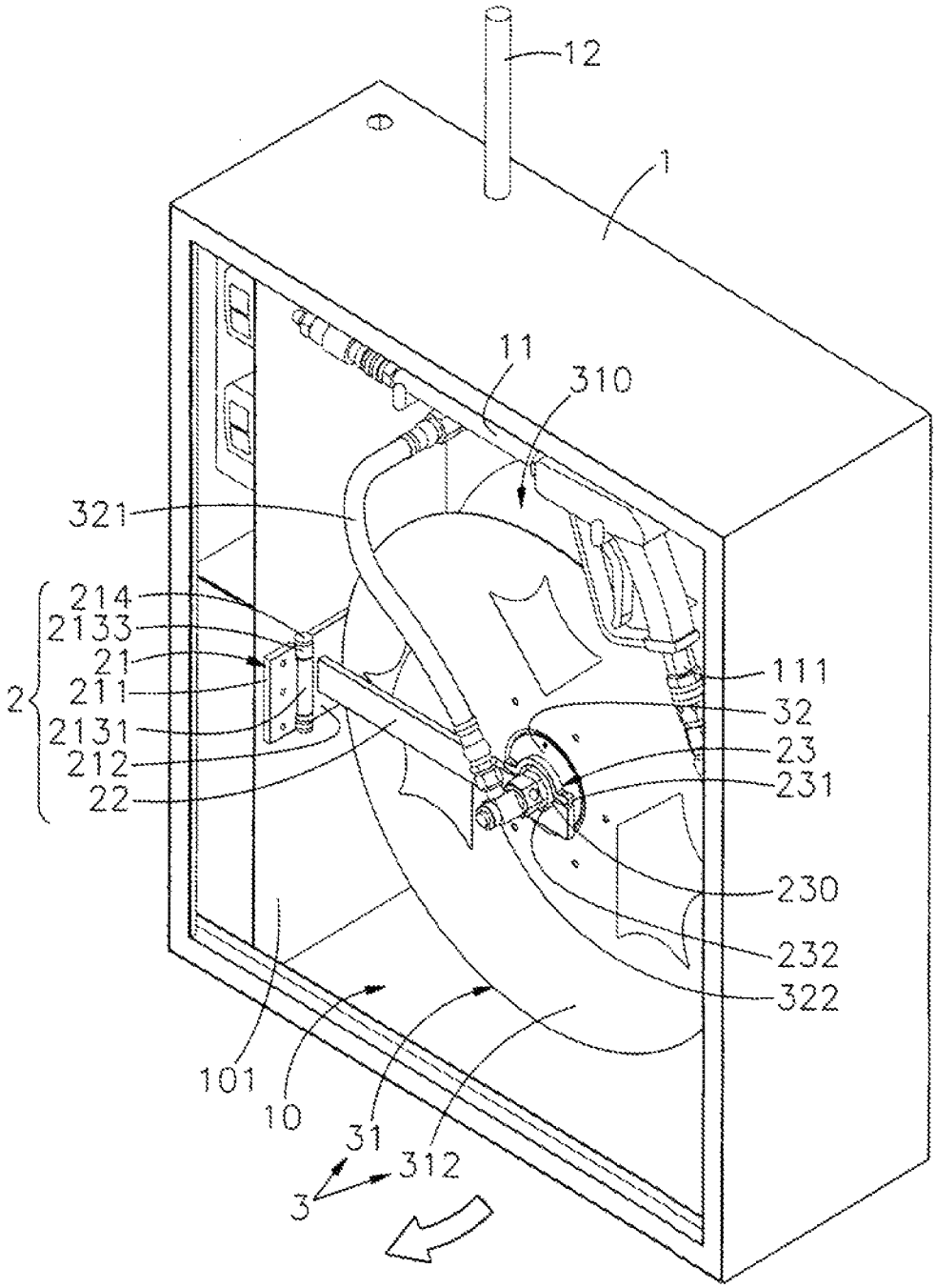
FIG. 5 is a perspective view of a preferred embodiment of the present invention.
Figure 6:
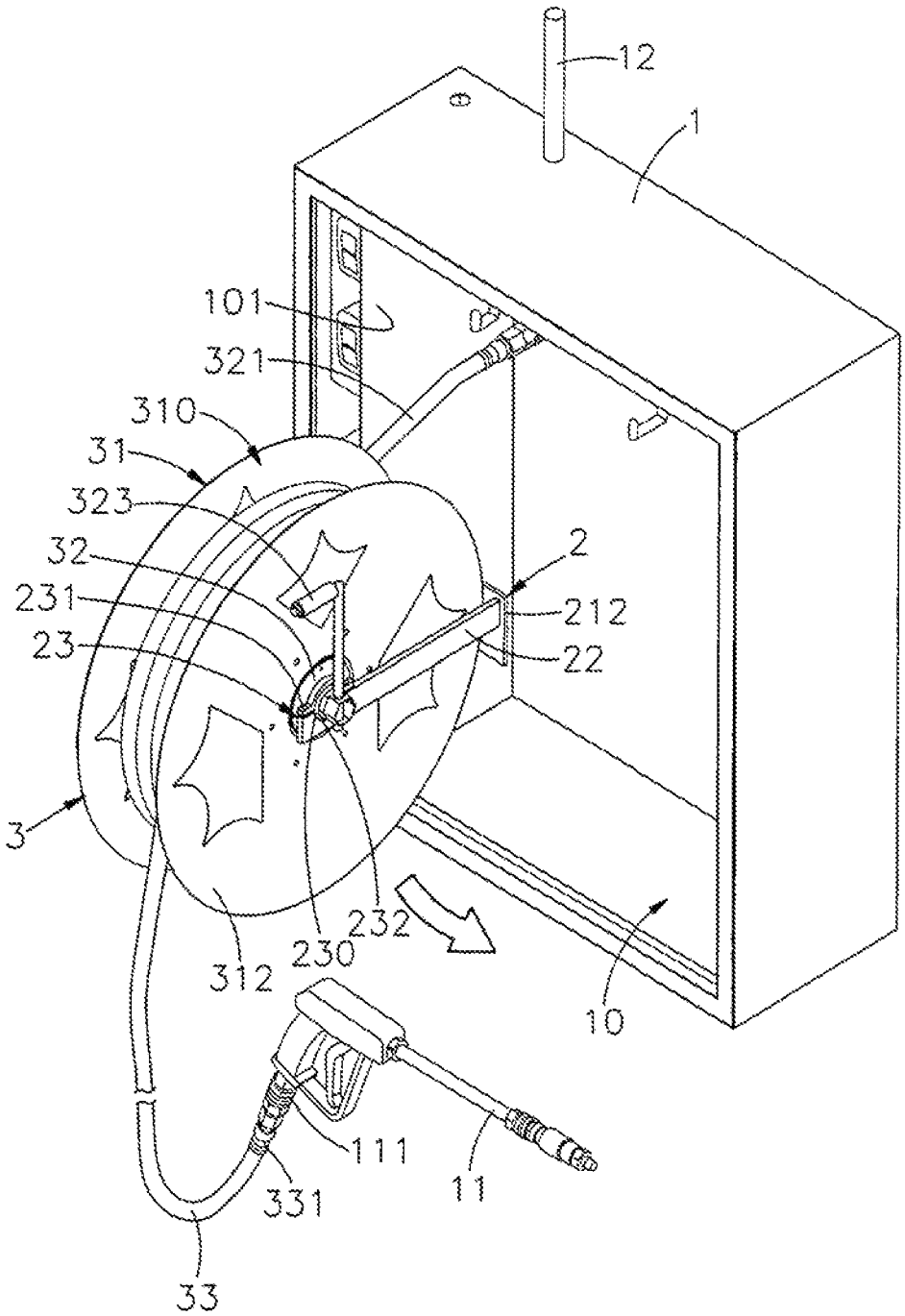
FIG. 6 is another perspective view of a preferred embodiment of the present invention.
Figure 7:
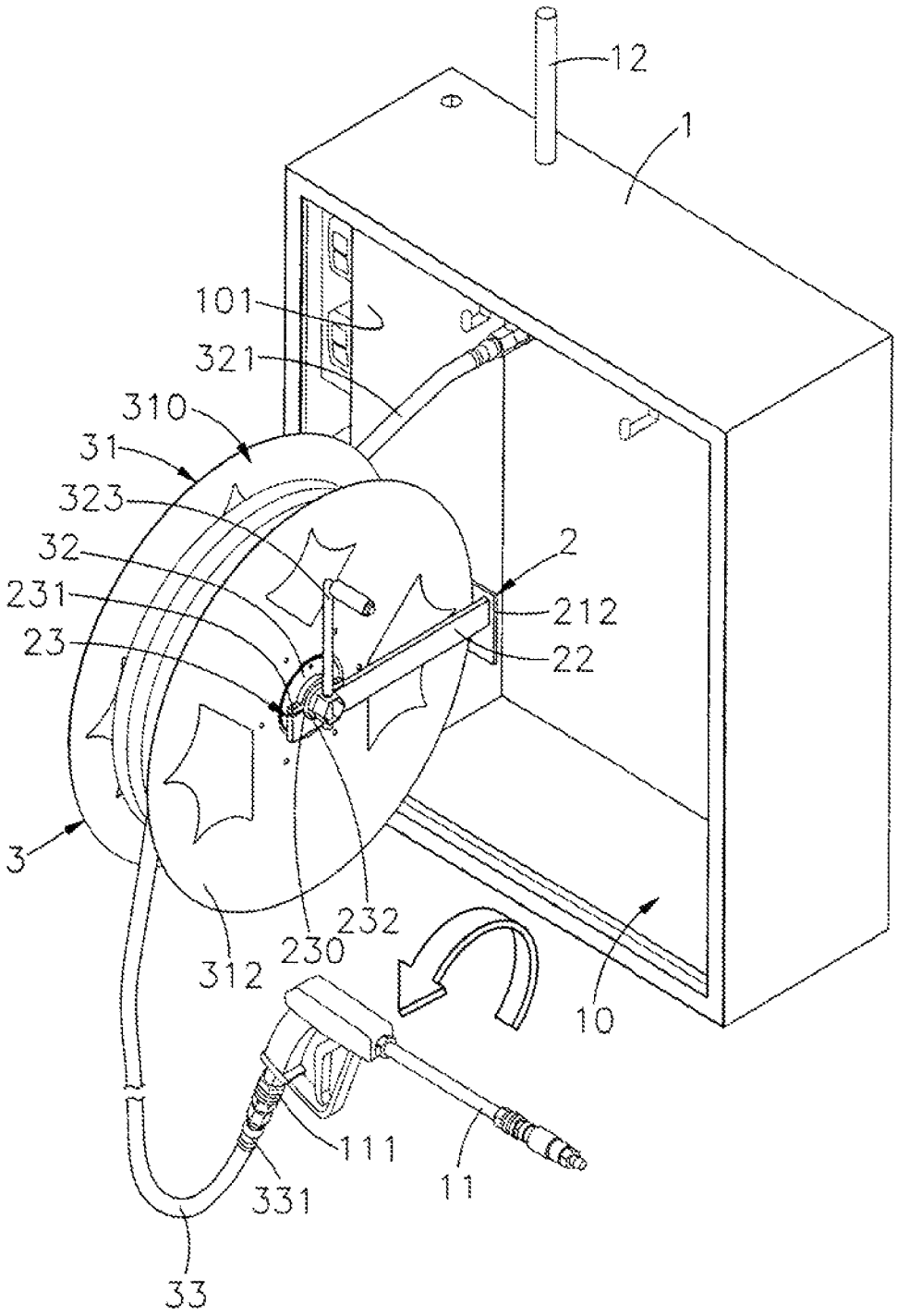
FIG. 7 is still another perspective view of a preferred embodiment of the present invention.
Figure 8:
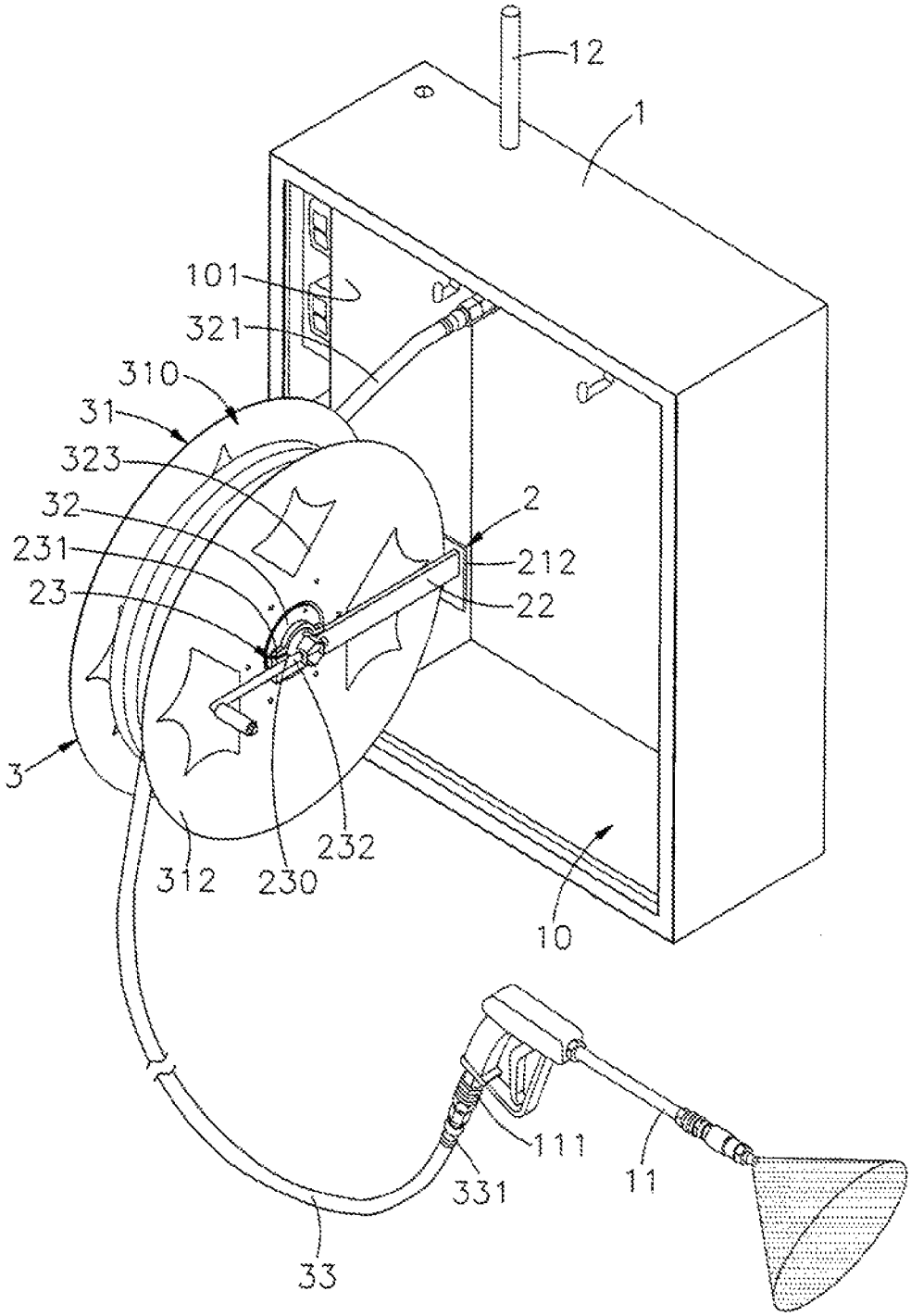
FIG. 8 is a perspective view of a preferred embodiment of the present invention in use.
Figure 9:
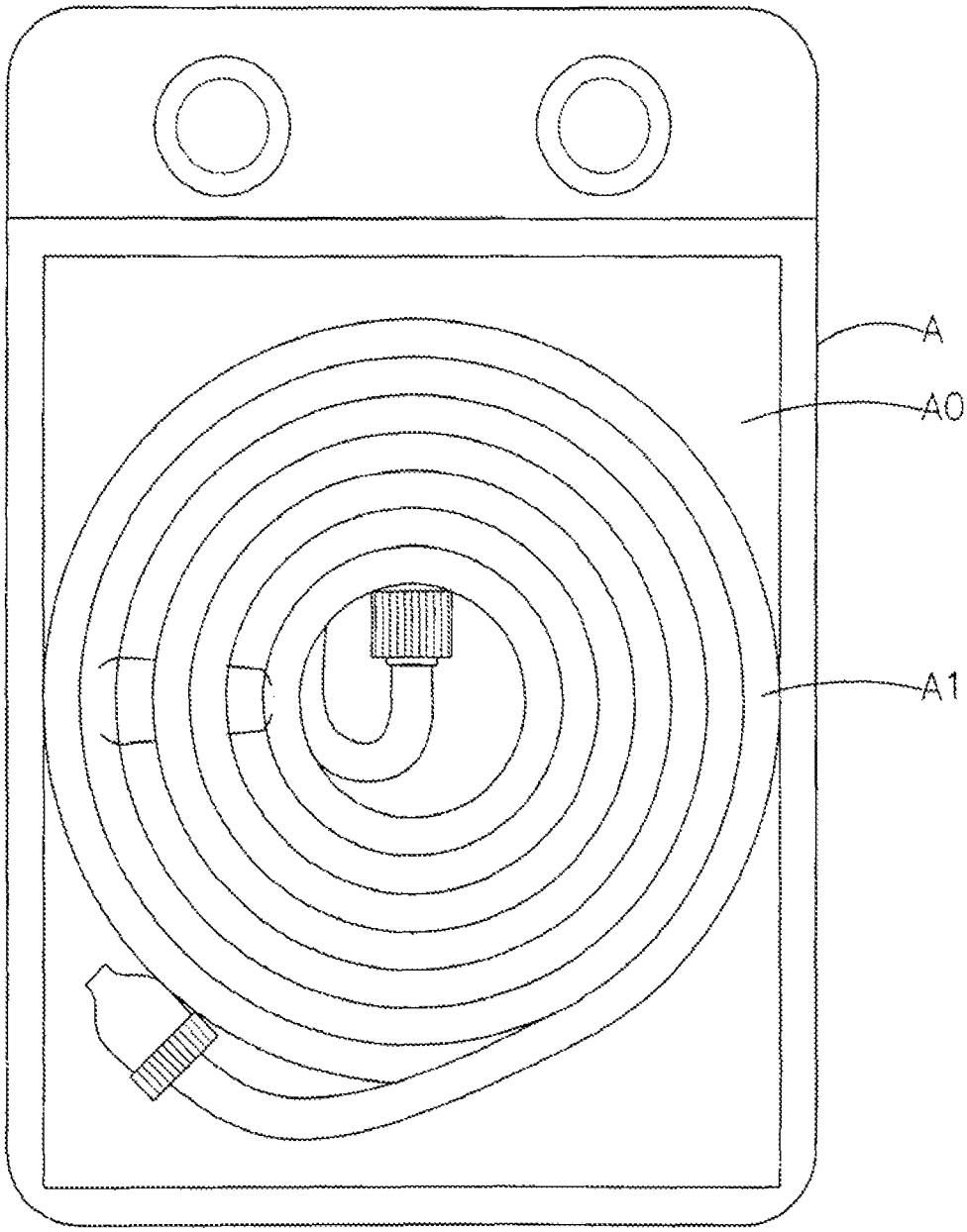
FIG.9 (PRIOR ART)
FIG. 9 is a front view of a conventional fire hydrant box.
Figure 10:
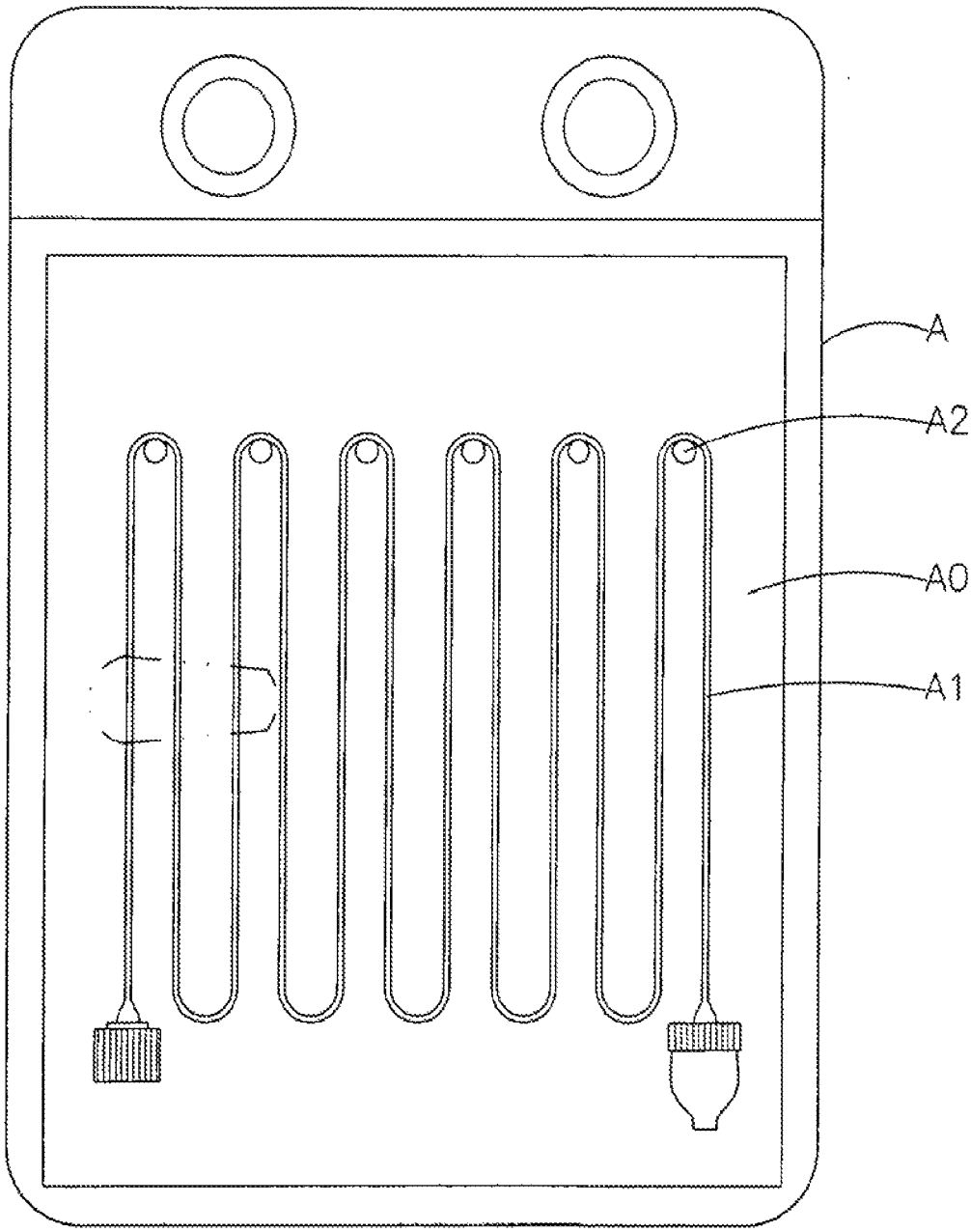
FIG.10 (PRIOR ART)
FIG. 10 is a front view of another conventional fire hydrant box.

Referring to FIGS. 2 and 5-8, when using the fire hydrant box of present invention, the firefighting hose assembly 3, which is supported by the connection unit 2 being fixed on the interior sidewall 101 of the accommodating space 10 of the box body 1, rotates 90 degrees outward from the accommodating space 10. The rotating assembly 21 has good weight carrying ability. By using the connecting mechanism 213 as an axle, the rotary member 212 of the rotating assembly 21 enables the two supporting members 22 to move the firefighting hose assembly 3 to rotate 90 degrees outward from the accommodating space 10, which means that the operation of the firefighting hose assembly 3 will not be hindered. The handle 323 is installed on the rolling disk 32 which is on one side of the rotating base 31, and is used to rotate the plurality of the rolling rods 3111 of the rolling mechanism 311, so that the fire hose 33 can be pulled out of the receiving space 310 formed between the two baffles 312. The firefighting spray gun 11 stored in the accommodating space 10 of the box body 1 can be taken out from the accommodating space 10 and is connected to the hose connector 331, which is on the distal end of the fire hose 33, via the water supply connector 111, so that the water (or foam, powder, or chemical agent, etc.) can be led from the water feeding pipe 12, and then transferred from the rotary connector 322 of the water supply pipe 321 to the connecting mechanism 311, the fire hose 33, and finally reach the firefighting spray gun 11 connected at the end of the fire hose 33 to do the fire extinguishing operation.

The fire hose 33 of the firefighting hose assembly 3 can be taken out from the receiving space 310 of the rotating base 31 easily by pulling the fire hose 33 and rotating the handle 323. After using the spray gun 11, the water supply connector 111 can be disconnected from the hose connector 331 of the fire hose 33, and the firefighting spray gun 11 can be stored in the accommodating space 10 of the box body 1. Meanwhile, the fire hose 33 can be wound up back to the receiving space 310 swiftly by the rotation of the rolling rod 3111 in an opposite direction. The fire hydrant box 10 of present invention is able to save time and efforts, preventing bending, knotting, or distortion by the time of pulling out or winding up the fire hose 33, which keeps the fire hose 33 in the best condition, and extend the life of the fire hose.

The connection unit 2 installed on the interior sidewall 101 of the accommodating space 10 of the box body 1 can move the firefighting hose assembly outside of the accommodating space 10 by the way of rotating the rotary member 212 of the rotating assembly 21 and the two supporting members 22, such that operating the firefighting hose assembly 3 will be easier and more maneuverable, and not hindered by the box body 1.

It should be understood that the above detailed description, including preferred embodiments of the invention are given by way of illustration only, and thus are not limitative of the present invention. In the fire hydrant box 10 of present invention, the connection unit 2 is installed to the interior sidewall 101 of the accommodating space 10 of the interior of the box body 1. The firefighting hose assembly 3 is supported by two supporting members 22 which extend from the rotary member 212 of the connection unit 2. The positioning member 211 of the rotating assembly 21 and the rotary member 212 can rotate smoothly relative to each other via the connecting mechanism 213 provided with a metal rotary shaft 214. The connecting mechanism 213 further includes a plurality of needle bearings 215 with the metal rotary shaft 214 passing therethrough, so that the purpose of swiftly taking out or restoring back the firefighting hose assembly 3 to the accommodating space 10 via the rotating assembly 21 can be achieved. The fire hose 33 can be wound up by a plurality of the rolling rods 3111 of the connecting mechanism 311 of the rotating base 31 of the firefighting hose assembly 3. Furthermore, the handle 323 provided the rolling disk 32 at one can be used to drive the plurality of the rolling rods 3111 of the connecting mechanism 311 to rotate, so as to wind up or release the fire hose 33. It should be noted that the above detailed description, including preferred embodiments of the invention is merely an illustration, and all the other modifications or the structure variations which have the equal function with present invention should be deem as in the scope of present invention.

The present invention has the following advantages.

1. The connection unit 2 installed on the interior sidewall 101 of the accommodating space 10 of the box body 1, wherein the rotating assembly 21 of the connection unit 2 has the rotary shaft 214 passing through a plurality of needle bearings 215, so that the firefighting hose assembly 3 can be swiftly taken out or restored back to the accommodating space 10. Thus, quickly taking out the fire hose 33 to do the fire extinguishing becomes possible, and no time will be wasted for taking out the fire hose 33.

2. The rotating base 31 of the firefighting hose assembly 3 uses the handle 323 provided to the rolling disk 32 at one side to rotate a plurality of the rolling rods 3111 of the connecting mechanism 311. When rotating the rolling rod 3111, the fire hose 33 can be wound up or released, and thus the fire hose 33 can be taken out or wound up swiftly. It is a time and effort saving way to operate the fire hose 33, thereby facilitating the fire extinguishing process, and diminishing the accidental lost.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A fire hydrant box, comprising:

a body comprising an accommodating space with a door member, a water inlet pipe passing through the accommodating space and configured to introduce external firefighting water supply, and a firefighting spray gun disposed in the accommodating space;

a connection unit placed on an interior sidewall of the body and comprising a rotating assembly rotatably disposed on the interior sidewall, and a pair of supporting members extending from the rotating assembly and forming two cantilever arms, each cantilever arm having a fixing mechanism, the rotating assembly further comprising:

a positioning member disposed on the interior sidewall;

a rotary member adjacent to the positioning member; and a connecting mechanism provided to corresponding sides, to be connected with each other, of the positioning member and the rotary member and configured to receive a rotary shaft passing therethrough, wherein the rotary member includes two slots, and the two supporting members are received and welded into the two slots respectively, and extend toward a same direction to form the two cantilever arms, the two cantilever arms being parallel with each other, wherein the fixing mechanism of each cantilever arm is disposed on a cantilever end of each cantilever arm and comprises a groove formed on the cantilever end and a corresponding arc clamping element, the corresponding arc clamping element being installed on the groove to form a clamping space, and wherein a plurality of needle bearings are provided to the connecting mechanism, the rotary shaft passing through and being supported by the plurality of needle bearings; and a firefighting hose assembly disposed within the accommodating space and comprising:

a rotary base configured to be received in the clamping spaces of the two cantilever arms, the rotary base comprising a fire hose winding thereon, the fire hose having a hose connector at an end of the fire hose and configured to be connected to said firefighting spray gun; and a pair of rolling disks disposed on two sides of the rotary base, one of the rolling disks being provided a handle configured to drive the rotary base so as to roll and release the fire hose, the other one of the rolling disks being coupled to a water supply pipe connected to the water inlet pipe, the handle including an arm rotatably connected to one of the rolling disks, the handle being rotatable about an axis of the arm, wherein when the firefighting hose assembly is positioned within the accommodating space, the two parallel cantilever arms extend in a first direction perpendicular to the positioning member, and when the firefighting hose assembly is rotated out of the accommodating space, the two parallel cantilever arms extend in a second direction parallel with the positioning member.

2. The fire hydrant box according to claim 1, wherein the body is configured to be installed on a predetermined wall inside a building, and the door member is movable for being opened and closed, the door member being a rotary single-plate door, a horizontal pulling single-plate door, a rotary double-plate door, a horizontal pull double-plate door or a coiling door.

3. The fire hydrant box according to claim 1, wherein the connecting mechanism includes a plurality of shaft holes configured to be passed through by the plurality of the needle bearings and the rotary shaft.

4. The fire hydrant box according to claim 1, wherein the rotary base further comprises a plurality of rolling rods and two baffles provided to two sides of the plurality of rolling rods respectively, the two baffles forming a receiving space therebetween, which is configured to receive and release the fire hose, and wherein the two rolling disks are placed on outer sides of the two baffles respectively.

5. The fire hydrant box according to claim 1, wherein a rotary connector is provided to connect the water supply pipe to one of the rolling disks.

* * * * *